US006223962B1

(12) United States Patent
Pimpis

(10) Patent No.: US 6,223,962 B1
(45) Date of Patent: May 1, 2001

(54) METHOD AND APPARATUS FOR ATTACHING A WEB OF MATERIAL FOR TRANSLATION THROUGH A ROTARY PRINTING PRESS SYSTEM

(75) Inventor: Robert Michael Pimpis, Dover, NH (US)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/335,368

(22) Filed: Jun. 17, 1999

(51) Int. Cl.[7] ..... B65H 20/00
(52) U.S. Cl. ..... 226/92; 242/332.4; 242/532.7
(58) Field of Search ..... 226/92; 242/332.4, 242/532.7, 562.1

(56) References Cited

U.S. PATENT DOCUMENTS 3,810,568 * 5/1974 Kwiaikowski et al. ..... 226/92
4,330,191 * 5/1982 Rawlings et al. ..... 226/92 X
4,480,801 * 11/1984 Stone ..... 242/532.7
4,706,862 * 11/1987 Theilacker ..... 226/92
4,773,580 * 9/1988 Schweiger ..... 226/92
4,987,830 * 1/1991 Fukuda et al. ..... 101/228
5,029,742 7/1991 Theilacker et al. .
5,333,771 * 8/1994 Cesario ..... 226/92
5,351,870 * 10/1994 Nagel et al. ..... 226/92
5,887,215 * 3/1999 Earle et al. ..... 396/651

* cited by examiner

*Primary Examiner*—Donald P. Walsh
*Assistant Examiner*—Collin A. Webb
(74) *Attorney, Agent, or Firm*—Herbert L. Lerner; Laurence A. Greenberg; Werner H. Stemer

(57) ABSTRACT

A method and an apparatus for attaching a web of material for translation through a rotary printing press system, include a triangle having a side with a given length and a bottom to be attached to the web. A guiding device is attached to the side of the triangle along substantially all of the given length, for guiding the triangle and the web.

28 Claims, 6 Drawing Sheets

METHOD AND APPARATUS FOR ATTACHING A WEB OF MATERIAL FOR TRANSLATION THROUGH A ROTARY PRINTING PRESS SYSTEM

BACKGROUND OF THE INVENTION

FIELD OF THE INVENTION

The invention relates to a method and an apparatus for attaching a web of material for translation through a rotary printing press system.

Single side web-up systems require measures for attaching a web to a guiding device (commonly known as a "snake"). Such measures generally take the form of a triangle (otherwise known as a kite). Side loads imposed by web tension across the web width are focused at the apex of the triangle, where the triangle is attached to the guiding device. Those side loads can cause the web to run off, or to cause wrinkling or tearing of the web.

Furthermore, the attachment of the triangle to the guiding device presents a problem in aligning the triangle relative to the intended web path so that offset loading and/or web displacement is avoided. Currently, triangles are joined to the guiding device at the apex of the triangle. That allows a rotational degree of freedom around which the triangle can pivot. That presents a problem when the attachment of the triangle is made to the web. Since the triangle is not fixed along the web path, it is difficult to align the triangle to the web. In addition, the edge of the triangle is difficult to locate so that it is coincident with the edge of the web.

The problem is compounded by restrictions which are imposed firstly by the small amount of space that an operator has to work in at a reel stand, and secondly by working on a round surface defined by the paper reel, as opposed to a preferably flat surface.

A conventional attachment of a guiding device to a web is shown in U.S. Pat. No. 5,039,742. In that device, a flexible pulling sheet which is attached to a web is secured to a pull-in element by attachment clamps. The pull-in element has a cable for threading the web through a printing machine.

SUMMARY OF THE INVENTION

It is accordingly an object of the invention to provide a method and an apparatus for attaching a web of material for translation through a rotary printing press system, which overcome the hereinafore-mentioned disadvantages of the heretofore-known methods and apparatuses of this general type, which prevent the web from running off, wrinkling or tearing, which aid in aligning the triangle relative to an intended web path and which accommodate space limitations and round paper reel surfaces.

With the foregoing and other objects in view there is provided, in accordance with the invention, an apparatus for attaching a web of material for translation through a rotary printing press system, the apparatus comprising a triangle having a side with a given length and a bottom to be attached to a web; and a guiding device attached to the side of the triangle along substantially all of the given length, for guiding the triangle and the web. Accordingly, an important part of the solution according to the invention is that the triangle is attached to the guiding device along the length where the triangle meets the guiding device.

In accordance with another feature of the invention, there are a series of attachment points so that the triangle is attached to the guiding device along the full length of the triangle. The reasons for this are firstly that alignment of the triangle is assured by the location of the fixed attachment points, and secondly that the triangle can easily be attached and detached by an operator.

In accordance with a further feature of the invention, the triangle is made of a reinforced material, similar to a mat made of fiberglass such as that sold under the trademark. FIBERGLAS. The mat could be woven, which gives a perpendicular orientation to the weaves. Since the mat material could be abrasive, the mat could have a coating to prevent marking when in contact with the web rolls. Materials which may be considered for the mat are those with aramid or carbon fibers and the coating may be an elastomeric, such as rubber or neoprene. The orientation of the reinforcement is critical to the triangle. In order to minimize areas of uneven stress due to web loads, one weave could be parallel with the hypotenuse of the triangle. The perpendicular weave is non-contributory. Such an orientation provides a multiplicity of triangles defined by each parallel strand in the mat. The strands act as structural supports from the web to attachment points at the guiding device. This results in an optimized load distribution to the guiding device, and eliminates the rotational degree of freedom tending to shift the web.

In accordance with an added feature of the invention, there is provided a stiffener pad at the bottom of the triangle, in close proximity to the web. This pad acts as a rigid support along the web width, so as to prevent web movement and wrinkling. The pad has compliance in the direction of web travel so as to allow it to flex over rolls as it draws the web. The preferred material for the stiffener pad is a polymer, although a metal could be used provided it does not cause marking on the rolls while in contact with them. A thermoplastic, acetal resins such as those sold under the trademark DELRIN or nylon may be used. The pad is joined to the triangle so as to become an integral part of the triangle. The pad has a slot through which the web passes in order to join the web to the triangle. The web is wrapped through the slot and joined to itself through the use of adhesive tape. The pad has a rounded edge at the slot to prevent tearing of the web.

In accordance with an additional feature of the invention, there is provided a clamping bar configuration at the bottom of the triangle, for attaching the triangle to the web. The clamping bar configuration has clamping bars with a rounded cross section which also prevent tearing of the web.

In accordance with yet another feature of the invention, the triangle attaches to the guiding device through the use of a series of linearly aligned grommets located in the triangle and parallel to the guiding device. The grommets engage with posts located on the guiding device, which act to retain the grommets during web-up. The posts are constructed in such a way as to prevent the grommet from coming off the post during web-up. The posts may also be constructed with an opening and closing feature to capture the grommets. The overall action is similar to a zipper. The post actuation would be operated by a device that would wedge the post closed to allow the grommet to pass over it. After the grommet has been located, the wedge would be removed, which allows the post to open to retain the grommet. This actuation device would be disposed at two press system locations, namely at the reel stand to load the triangle, and at the folder gathering roll to unload the triangle.

In accordance with yet a further feature of the invention, there is provided a zipper used in place of the post and grommet configuration. This feature has the advantage of a tightly spaced support as determined by the pitch of the teeth in the zipper. The zipper also has an inherent flexibility along the path of web travel, and is easy to attach and detach. An automated device could be utilized to eliminate manual attachment and detachment.

In accordance with yet an added feature of the invention, there is provided a post actuation device for attaching the triangle to the guiding device, the post actuation device having a train guide for guiding the posts and a triangle guide for guiding the grommets over the posts. The triangle guide has a slot formed therein for receiving one of the posts.

The post actuation device is used to effectively attach the triangle to the guiding device without manually placing each grommet over its mating post. Only the first grommet requires manual alignment to initiate the attachment.

This device may be used to automatically engage a multiplicity of grommets onto mating post locations to effectively capture a length of a triangle onto the guiding device. The device has the ability to also detach the triangle, and could lead to the use of automatic unwinding devices to play the triangle onto the train, or winding devices to remove and store the triangle.

With the objects of the invention in view, there is also provided a method for attaching a web of material for translation through a rotary printing press system, which comprises providing a triangle having a side with a given length and a bottom; attaching the bottom to a web; and attaching a guiding device along substantially all of the given length of the side of the triangle, for guiding the triangle and the web.

In accordance with another mode of the invention, there is provided a method which comprises carrying out the attaching step by attaching the side of the triangle to the guiding device at fixed attachment points. The side of the triangle may be removably attached to the guiding device and may be attached with posts and grommets or with a zipper.

In accordance with a further mode of the invention, there is provided a method which comprises providing a stiffener pad at the bottom of the triangle, and carrying out the step of attaching the bottom of the triangle to the web by feeding the web through a slot formed in the stiffener pad. The web is joined to itself with an adhesive after passing through the slot.

In accordance with an added mode of the invention, there is provided a method which comprises providing a clamping bar configuration at the bottom of the triangle, and carrying out the step of attaching the bottom of the triangle to the web by clamping the web to the triangle with the clamping bar configuration. Clamping bars of the clamping bar configuration may be fastened by screws or clips.

In accordance with a concomitant mode of the invention, there is provided a method which comprises guiding the posts with a train guide and guiding the grommets over the posts with a triangle guide, of a post actuation device.

Other features which are considered as characteristic for the invention are set forth in the appended claims.

Although the invention is illustrated and described herein as embodied in a method and an apparatus for attaching a web of material for translation through a rotary printing press system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
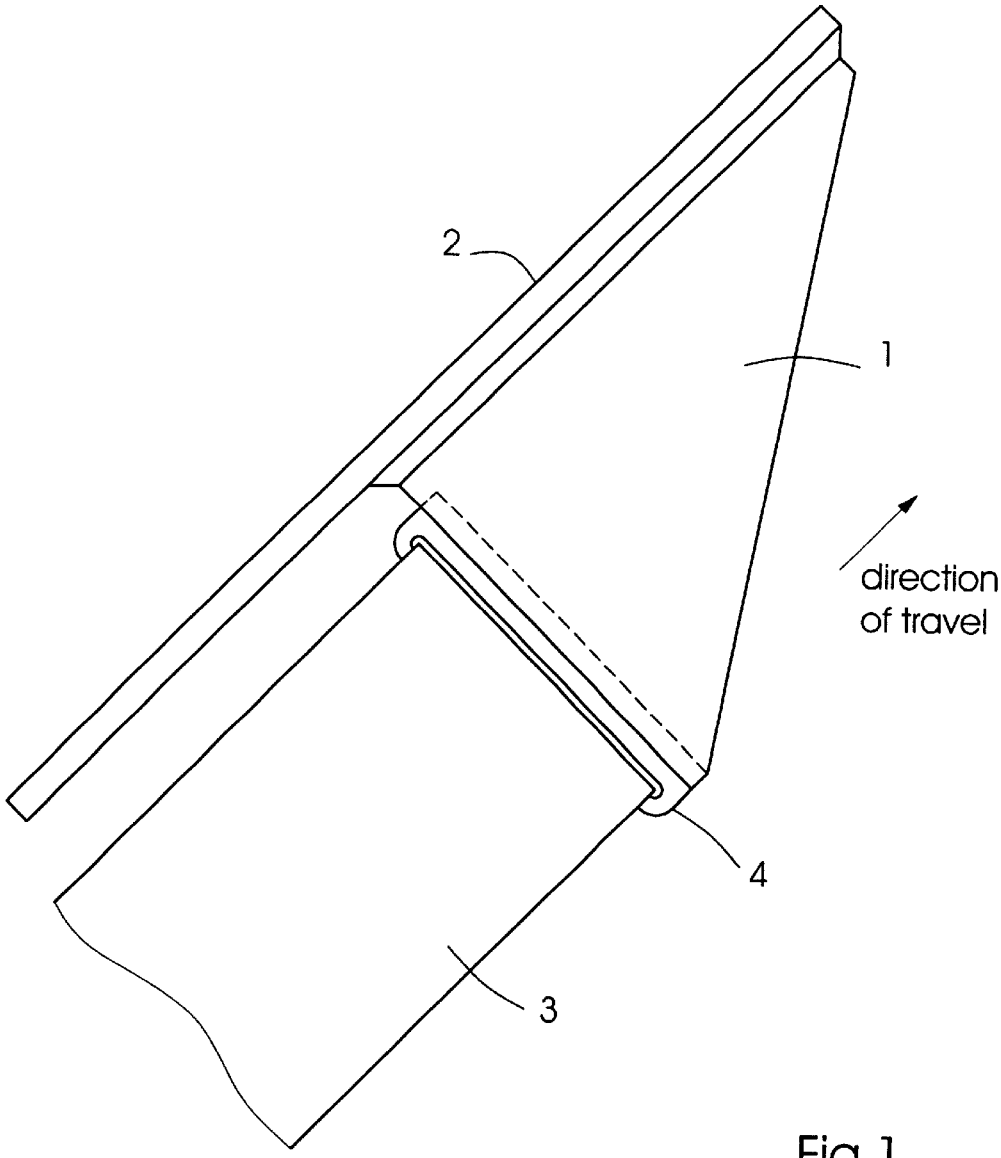
FIG. 1 is a fragmentary, diagrammatic, top-plan view of a web attaching apparatus according to the invention, having a triangle attached to a guiding device and to a web.

Referring now to the figures of the drawings in detail and first, particularly, to FIG. 1 thereof, there is seen an embodiment of an apparatus according to the invention, in the form of a single-side web-up device, for attaching a web of material for translation through a rotary printing press system. The apparatus includes a triangle or kite 1 which is attached to a web 3 and to a guiding device or snake 2.

The triangle 1 shown in the overall view of FIG. 1 is attached to the guiding device 2 in such a way as to provide translation in a direction of travel indicated by an arrow, as well as to provide support for the web 3. A stiffener pad 4 provides the support across the web and acts as an attachment interface of the triangle to the web.

Figure 2:
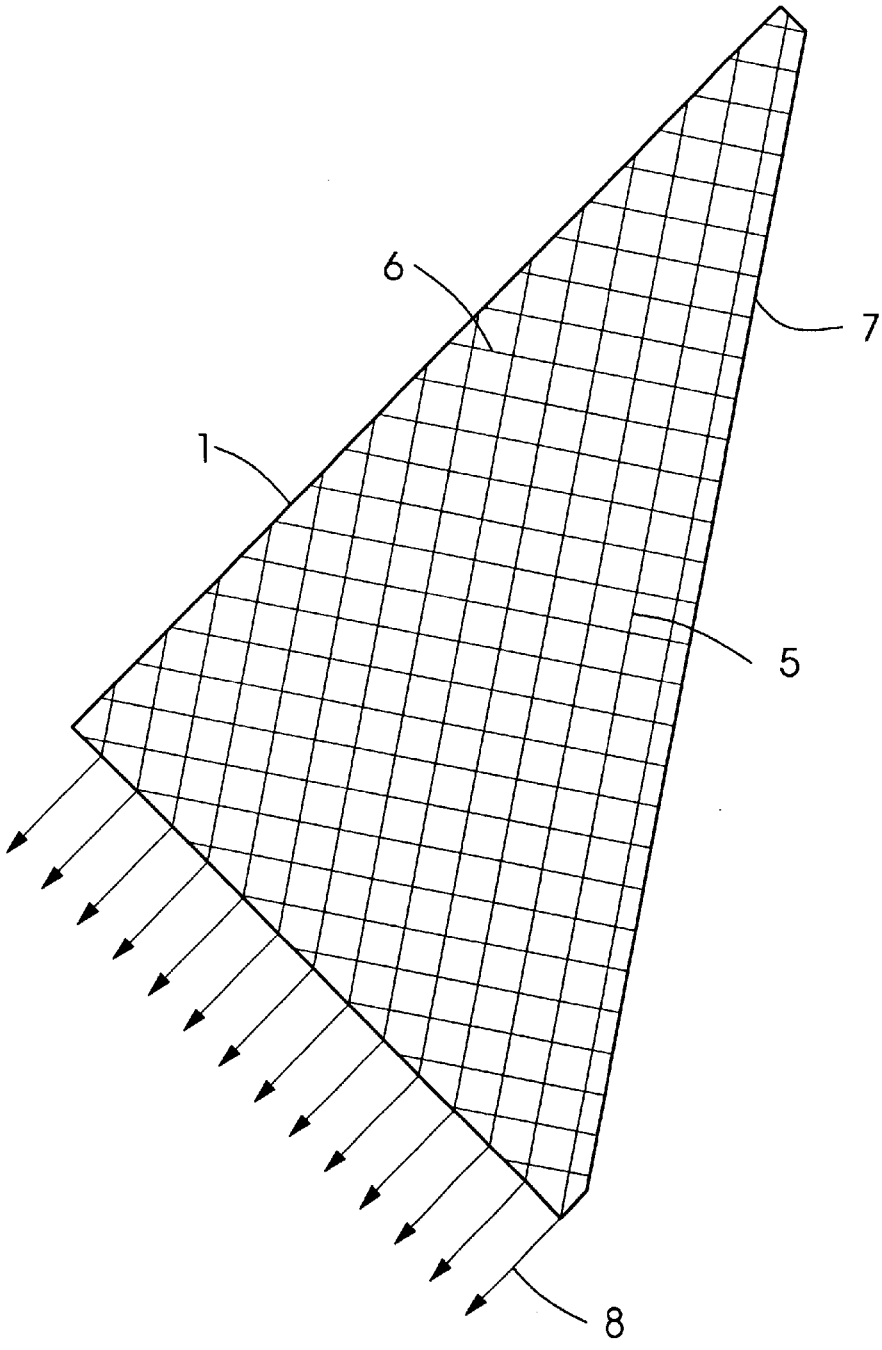
FIG. 2 is a top-plan view of a triangle indicating details of a woven mat thereof.

FIG. 2 shows a reinforcement orientation of the triangle 1 which is used to describe a parallel and perpendicular lay of a mat material. The triangle 1 is formed of a woven mat. The mat has a parallel weave 5 and a perpendicular weave 6, as oriented relative to the hypotenuse 7 of the triangle, for a distribution of loads 8 from web tension. The mat may be formed of a fiberglass material such as that sold under the trademark FIBERGLAS.

Figure 3A:
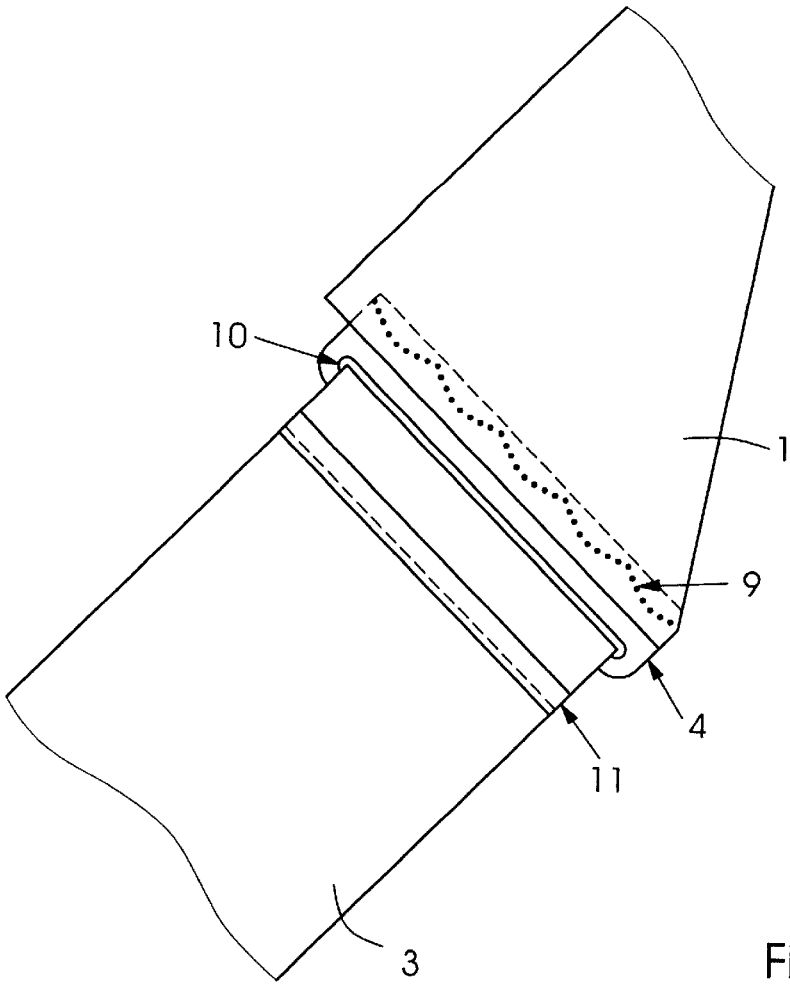
FIG. 3*a* fragmentary, top-plan view of the triangle attached to the web.
Figure 3B:
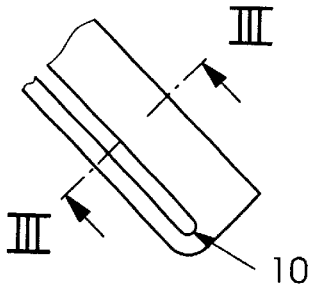
FIG. 3*b* is an enlarged, fragmentary, top-plan view of a portion of the triangle shown in FIG. 3*a*, in which the web has been omitted.
Figure 3C:
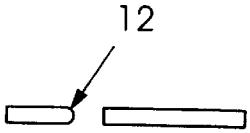
FIG. 3*c* is a cross-sectional view taken along a line III—III of FIG. 3*b,* in the direction of the arrows.

FIG. 3*a* shows details of triangle stiffener and attachment configurations. The triangle 1 and the web 3 are interconnected by the stiffener pad 4. The pad 4 is joined to the triangle 1 by an adhesive and/or by stitching 9. The web 3 passes through a slot 10 to secure the web to itself with adhesive tape 11. The slot 10 is shown without the web in FIG. 3*b*. FIG. 3*c* shows that the slot 10 has an edge piece 12 of a rounded material to prevent the web from severing due to the thin nature of the stiffener pad 4.

Figure 4A:
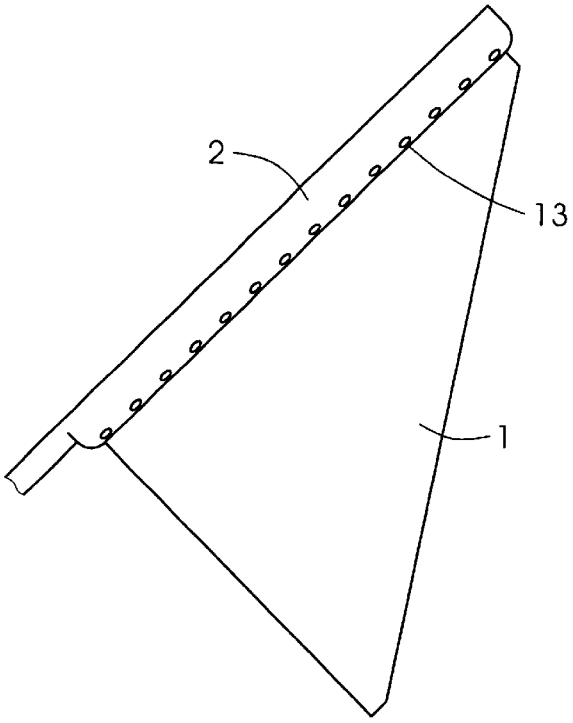
FIG. 4*a* is a fragmentary, top-plan view of the triangle attached to the guiding device by posts and grommets.
Figure 4B:
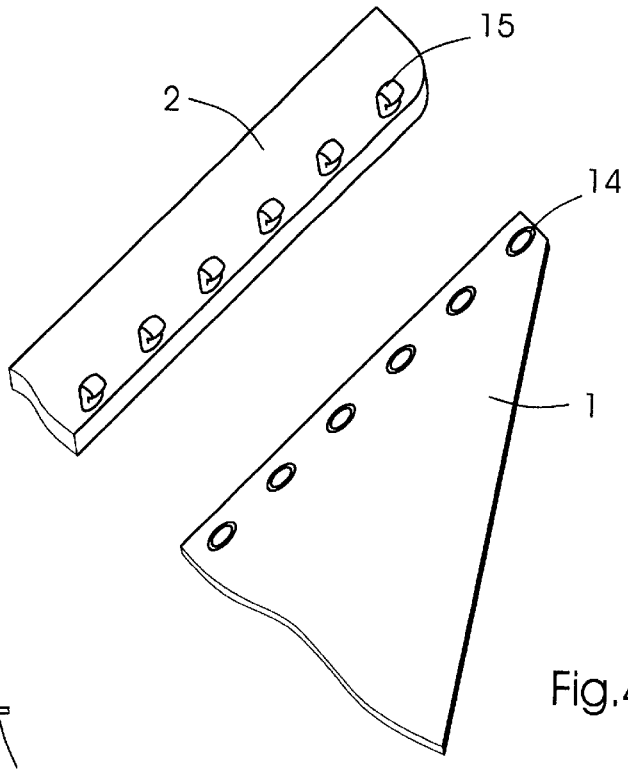
FIG. 4*b* is an enlarged, fragmentary, top-plan view of a portion of the triangle and guiding device shown in FIG. 4*a;*
Figure 4C:
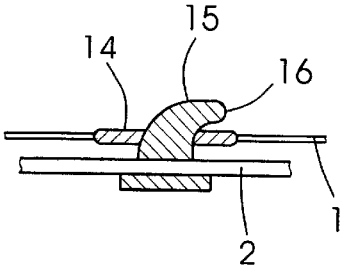
FIG. 4*c* is a further enlarged, fragmentary, sectional perspective view indicating details of a post and a grommet.

FIG. 4*a* shows a post and grommet configuration 13 for attachment of the triangle 1 to the guiding device 2. The triangle 1 is attached to the guiding device 2 along the length of the triangle. As is best seen in FIG. 4*b*, a grommet 14 is slipped over a post 15 in such a way that the post captures the grommet. FIG. 4*c* shows that the post 15 has a lip 16 facing in the direction of web travel that acts to retain the grommet 14 and prevent the triangle 1 from stripping off of the guiding device 2. However, the structure of the post 15 allows easy removal of the triangle.

Figure 5:
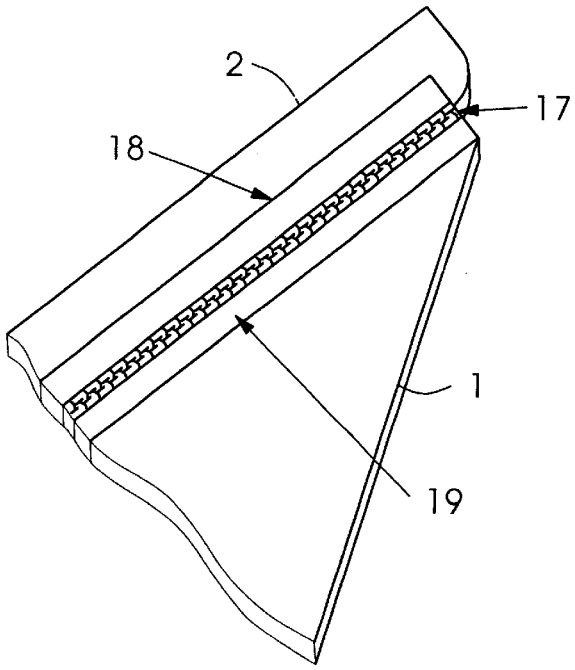
FIG. 5 is a fragmentary, top-plan view of the triangle attached to the guiding device by adhesive, stitching and a zipper.

FIG. 5 shows a zipper configuration for attachment of the triangle 1. A zipper 17 shown in the figure has the same function as the post and grommet configuration. The zipper 17 is attached to the guiding device 2 and to the triangle 1 by adhesive 18 and/or by stitching 19. It is understood that the location of the adhesive 18 and the stitching 19 relative to the zipper 17 may be the opposite of that shown. Furthermore, both attachments may be adhesive or both may be stitching.

Figure 6A:
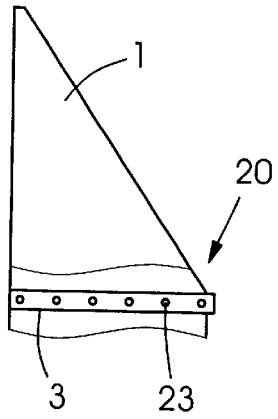
FIG. 6*a* is a reduced, top-plan view of the triangle having a clamping bar configuration attached to the web.

FIG. 6*a* illustrates an attachment of the triangle or flexible kite 1 to the web 3 by using a clamping bar configuration 20.

Figure 6B:
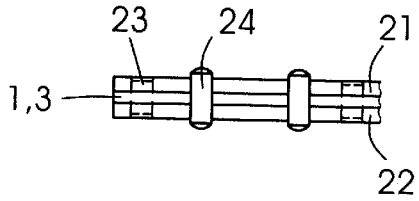
FIG. 6*b* is a side-elevational view of the triangle, clamping bar configuration and web of FIG. 6*a;*
Figure 6C:
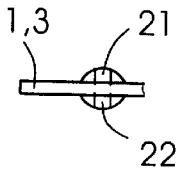
FIG. 6*c* is an end-elevational view showing the clamping bars, the triangle and the web.

FIG. 6*b* shows that the clamping bar configuration includes two clamping bars 21 and 22, between which the triangle 1 and the web 3 are clamped. The clamping bars 21, 22 may be held together by screws 23 and/or clips 24 which may be recessed or disposed in grooves. According to FIG. 6*c*, the clamping bars 21, 22 may be dome-shaped.

Figure 7A:
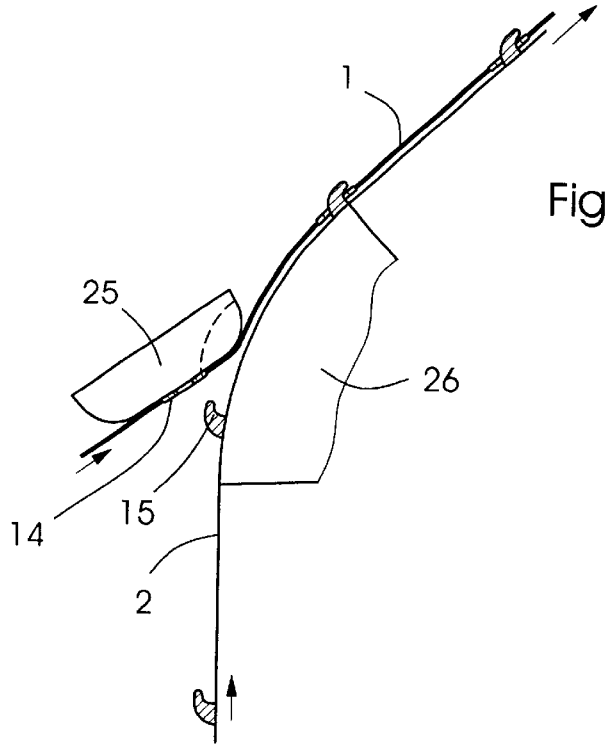
FIG. 7*a* is a side-elevational view of the triangle, the guiding device and a post actuation device.

FIG. 7*a* shows the triangle and the guiding device, snake or train in a side view. A post actuation device is provided in order to attach the triangle 1 to the guiding device 2 without having to place each grommet 14 over a respective post 15.

Figure 7B:
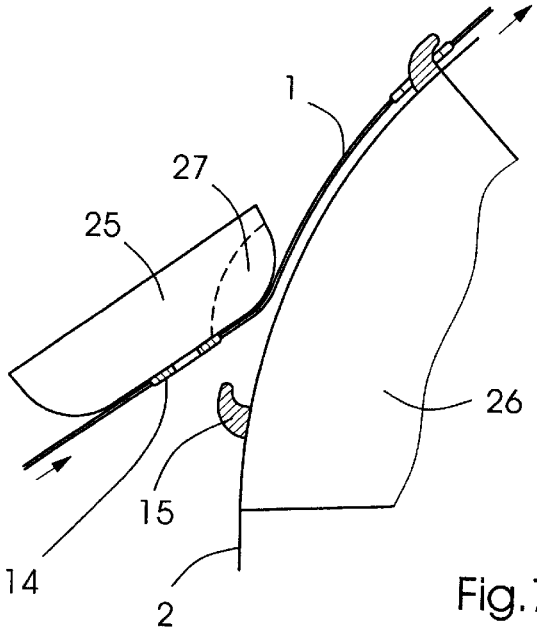
FIG. 7*b* is an enlarged, fragmentary, side-elevational view of the triangle, the guiding device and the post actuation device.
Figure 7C:
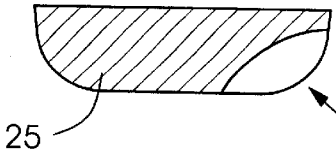
FIG. 7*c* is a sectional view of a triangle guide of the post actuation device.
Figure 7D:
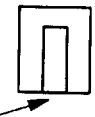
FIG. 7*d* is an end-elevational view of the triangle guide.

The post actuation device includes a triangle guide 25 and a train guide 26 for attaching the triangle 1 to the guiding device 2. As is seen in FIG. 7*b*, the triangle guide 25 orients the grommets 14 perpendicular to the posts 15 in such a way that the shanks of the posts 15 are able to pass through the eyes of the grommets 14. The figure also shows that the train guide 26 acts to maintain the orientation of the guiding device 2 while this action is taking place. A post 15 is able to pass through a slot 27 in the triangle guide 25, which is seen in FIGS. 7*c* and 7*d*. After the post 15 has passed through the eye of the grommet 14, the triangle 1 and the guiding device are aligned in parallel to lock the grommet 14 onto the post 15. This prevents separation of the two components during subsequent travel of the combination.

I claim:

1. An apparatus for attaching a web of material for translation through a rotary printing press system, the apparatus comprising:

a triangle having a side with a given length, a bottom to be attached to a web and a hypotenuse, said triangle made of reinforced material, said reinforced material having an orientation parallel to said hypotenuse; and a guiding device removably attached to said side of said triangle at fixed attachment points along substantially all of said given length, for guiding said triangle and the web.

2. The apparatus according to claim 1, wherein said side of said triangle is attached to said guiding device by posts and grommets.

3. The apparatus according to claim 2, including a post actuation device for attaching said triangle to said guiding device, said post actuation device having a train guide for guiding said posts and a triangle guide for guiding said grommets over said posts.

4. The apparatus according to claim 3, wherein said triangle guide has a slot formed therein for receiving one of said posts.

5. The apparatus according to claim 1, wherein said side of said triangle is attached to said guiding device by a zipper.

6. The apparatus according to claim 1, wherein said triangle made of woven material.

7. The apparatus according to claim 1, wherein said triangle is made of a fiberglass mat.

8. The apparatus according to claim 1, wherein said triangle is made of a coated abrasive material.

9. The apparatus according to claim 1, including a stiffener pad at said bottom of said triangle, said stiffener pad attaching said triangle to the web.

10. The apparatus according to claim 9, wherein said stiffener pad is made of a material selected from the group consisting of a polymer and a metal.

11. The apparatus according to claim 9, wherein said stiffener pad is joined to said triangle, so as to become an integral part of said triangle.

12. The apparatus according to claim 9, wherein said stiffener pad has a slot formed therein for receiving the web.

13. The apparatus according to claim 12, wherein the web is joined to itself by an adhesive after passing through said slot.

14. The apparatus according to claim 9, wherein said stiffener pad has a rounded edge at said slot.

15. The apparatus according to claim 9, wherein said stiffener pad is pliable in a web travel direction.

16. The apparatus according to claim 1, including a clamping bar configuration at said bottom of said triangle, said clamping bar configuration attaching said triangle to the web.

17. The apparatus according to claim 16, wherein said clamping bar configuration has clamping bars with a rounded cross section.

18. A method for attaching a web of material for translation through a rotary printing press system, the method which comprises:

providing a triangle having a side with a given length, a bottom, and a hypotenuse, the triangle being made of reinforced material having an orientation parallel to the hypotenuse;

attaching the bottom to a web; and attaching a guiding device along substantially all of the given length of the side of the triangle, for guiding the triangle and the web.

19. The method according to claim 18, which comprises carrying out the attaching step by attaching the side of the triangle to the guiding device at fixed attachment points.

20. The method according to claim 18, which comprises carrying out the attaching step by removably attaching the side of the triangle to the guiding device.

21. The method according to claim 18, which comprises carrying out the attaching step by attaching the side of the triangle to the guiding device with posts and grommets.

22. The method according to claim 21, which comprises guiding the posts with a train guide and guiding the grommets over the posts with a triangle guide, of a post actuation device.

23. The method according to claim 18, which comprises carrying out the attaching step by attaching the side of the triangle to the guiding device with a zipper.

24. The method according to claim 18, which comprises providing a stiffener pad at the bottom of the triangle, and carrying out the step of attaching the bottom of the triangle to the web by feeding the web through a slot formed in the stiffener pad.

25. The method according to claim 24, which comprises joining the web to itself with an adhesive after passing through the slot.

26. The method according to claim 18, which comprises providing a clamping bar configuration at the bottom of the triangle, and carrying out the step of attaching the bottom of the triangle to the web by clamping the web to the triangle with the clamping bar configuration.

27. An apparatus for attaching a web of material for translation through a rotary printing press system, the apparatus comprising:

a triangle having a side with a given length and a bottom to be attached to a web;

a guiding device attached to said side of said triangle along substantially all of said given length, for guiding said triangle and the web, said guiding device attaching to said triangle by posts and grommets; and a post actuation device for attaching said triangle to said guiding device, said post actuation device having a train guide for guiding said posts and a triangle guide for guiding said grommets over said posts.

28. The apparatus according to claim 27, wherein said triangle guide has a slot formed therein for receiving one of said posts.

* * * * *